US005836046A

United States Patent [19]

Huffman et al.

[11] Patent Number: 5,836,046

[45] Date of Patent: Nov. 17, 1998

[54] PORTABLE WATER EXTRACTION CLEANER

[75] Inventors: Eric C. Huffman, Lowell; Robert C. Coon, Holland; Douglas J. Medema, Belding, all of Mich.

[73] Assignee: Bissell Inc., Grand Rapids, Mich.

[21] Appl. No.: 884,453

[22] Filed: Jun. 27, 1997

Related U.S. Application Data

[60] Provisional application No. 60/025,995 Sep. 12, 1996.

[51] Int. Cl.[6] ..... A47L 11/34

[52] U.S. Cl. ..... 15/321; 15/323; 15/327.5; 15/352; 15/353

[58] Field of Search ..... 15/320, 321, 353

[56] References Cited

U.S. PATENT DOCUMENTS

| | | | |
|---|---|---|---|
| 3,101,505 | 8/1963 | Belicka et al. | 15/320 |
| 3,262,146 | 7/1966 | Hays | 15/321 |
| 3,316,579 | 5/1967 | Smith . | |
| 3,639,939 | 2/1972 | Crener et al. . | |
| 4,019,218 | 4/1977 | Cyphert | 15/321 |
| 4,216,563 | 8/1980 | Cyphert | 15/353 X |
| 4,549,329 | 10/1985 | St. Clair . | |
| 4,724,573 | 2/1988 | Ostergaard | 15/321 |
| 4,809,397 | 3/1989 | Jacobs et al. | 15/353 X |
| 5,063,633 | 11/1991 | Ingermann et al. | 15/320 |
| 5,237,719 | 8/1993 | Dwyer et al. | 15/321 |
| 5,237,720 | 8/1993 | Blase et al. | 15/321 |
| 5,301,386 | 4/1994 | Thomas et al. | 15/321 |
| 5,367,740 | 11/1994 | McCray . | |
| 5,383,251 | 1/1995 | Whitaker et al. . | |
| 5,477,578 | 12/1995 | Duncan et al. | 15/320 X |
| 5,500,977 | 3/1996 | McAllise et al. . | |
| 5,507,068 | 4/1996 | Fan et al. . | |

*Primary Examiner*—Chris K. Moore

*Attorney, Agent, or Firm*—Rader, Fishman, Grauer & MC Garry

[57] ABSTRACT

A water extraction cleaner comprises a system for delivering clean solution to a surface to be cleaned, a system for extracting dirty solution and air from such a surface, and a housing supporting the delivery system and the extraction system. The housing defines a recess for receiving a pair of tanks, an upright front surface of the recess being complementary to upright rear surfaces of the tanks. The housing is also provided with a pivot surface spaced from the upright surface of the recess and engageable by lower end portions, the pivot surface being formed and disposed to hold the upright surfaces of the tanks in snug engagement with the upright recess surface. Each of the tanks may be mounted on the housing by tilting the tank to insert the lower end portion thereof into the recess and then rotating the tank to an upright position about the pivot surface. The delivery system includes an inlet on the housing disposed to receive clean solution from one of the tanks when it is received in the recess in the upright position. The extraction system includes an outlet on the housing disposed to deliver dirty solution and air to the other of the tanks when it is received in the recess in the upright position. A detent arrangement is provided to removably secure the tanks on the housing in these operative positions, and the clean-solution tank includes a valve mechanism automatically actuated to permit flow from the tank when it is in its operative position.

13 Claims, 8 Drawing Sheets

PORTABLE WATER EXTRACTION CLEANER

BACKGROUND OF THE INVENTION

1. Field of the Invention

This invention relates to a fluid extraction cleaning apparatus and, more particularly, to a hand-held, portable water extraction cleaner having an accessory hose and one of several cleaning tools attached thereto.

2. Description of the Related Art

Water extraction cleaning machines can take one of several forms, such as an upright cleaner as seen in U.S. Pat. No. 5,500,977 to McAllise et al. or a canister-type cleaner as seen in U.S. Pat. No. 5,237,720 to Blase et al. Alternatively, the extraction cleaner can be a portable or hand-held cleaner as seen in U.S. Pat. No. 4,910,828 to Blase et al. In portable water extraction cleaners, an accessory hose extends from the housing and incorporates means for applying cleaning solution to the surface to be cleaned and a cleaning tool for assisting in the removal of the solution and entrained dirt.

SUMMARY OF THE INVENTION

The present invention provides a fluid extraction cleaning apparatus equipped with a system for delivering clean solution to a surface to be cleaned, a system for extracting dirty solution and air from such a surface, a housing for the delivery and extraction systems, a clean-solution tank, and a dirty-solution tank. The housing defines a recess for removably receiving the tanks which is preferably provided with a generally upright front surface. It also has a stop spaced forwardly from its upright surface which is engageable by lower end portions of the tanks.

The stop is so formed and disposed as to hold generally upright rear surfaces of the tanks in engagement with the front surface of the recess or a portion of the front surface. In a preferred embodiment of the invention, the stop is provided in the form of a pivot surface, whereby each of the tanks may be mounted on the housing by tilting the tank to insert its lower end portion into the recess and then rotating the tank to an upright position about the pivot surface.

The upright front surface of the housing is preferably complementary to the upright rear surfaces of the tanks. When, in such an embodiment, the lower end of each tank is inserted in the recess and the tank is rotated to the upright position, the pivot surface will hold the rear surfaces of the tanks in snug engagement with the complementary front surface of the recess.

The delivery system includes an inlet provided on the housing in a position to receive clean solution from the first tank when it is received in the recess in its upright position. Similarly, the extraction system includes an outlet on the housing in a position to deliver dirty solution and air to the second tank when it too is received in the recess in the upright position.

The front recess surface is preferably formed with a pair of detent projections and the rear surface of each of the tanks is formed with a detent indentation complementary to one of the detent projections and disposed to be interengaged therewith when the respective tank is received in the recess in the upright position.

An upper portion of each of the tanks is preferably formed with a finger hold to facilitate tilting it from the upright position about the pivot surface to remove the tank from the recess.

In a preferred embodiment, the clean-solution tank is provided with an outlet and a valve mechanism disposed in a normally closed condition to prevent flow from the tank outlet when the tank is removed from the recess. The tank outlet is so situated on the tank as to be aligned with the delivery system inlet when the tank is received in the recess in the upright position. A valve actuator is carried on the housing in a position such that, when the tank outlet is aligned with the delivery system inlet, the actuator is effective to move the valve mechanism to an open condition permitting flow from the tank outlet.

BRIEF DESCRIPTION OF THE DRAWINGS

The invention will now be described with reference to the drawings in which.

DETAILED DESCRIPTION OF THE PREFERRED EMBODIMENTS

Figure 1:
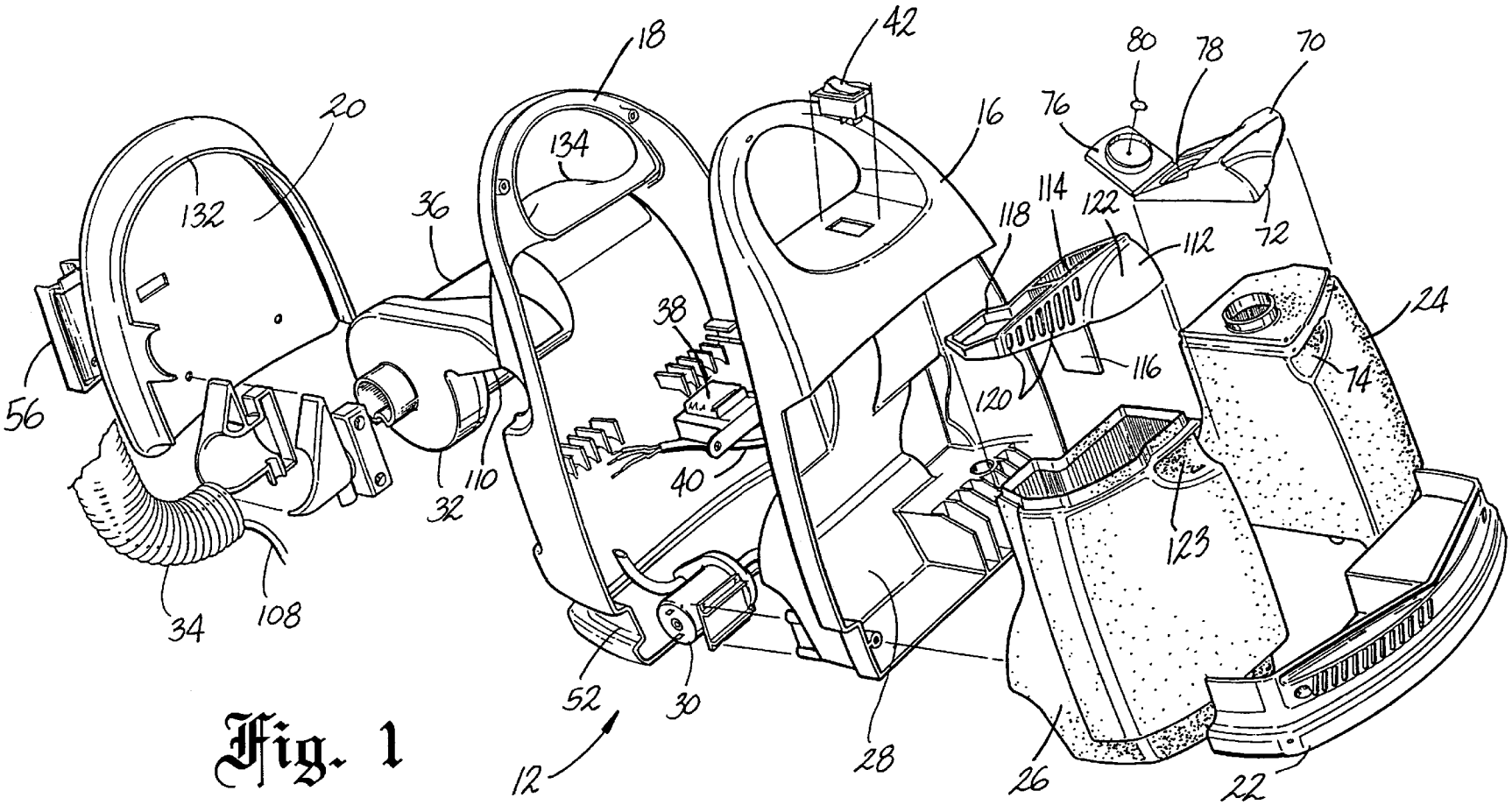
FIG. 1 is an exploded view of the portable water extraction cleaner according to the invention.
Figure 2:
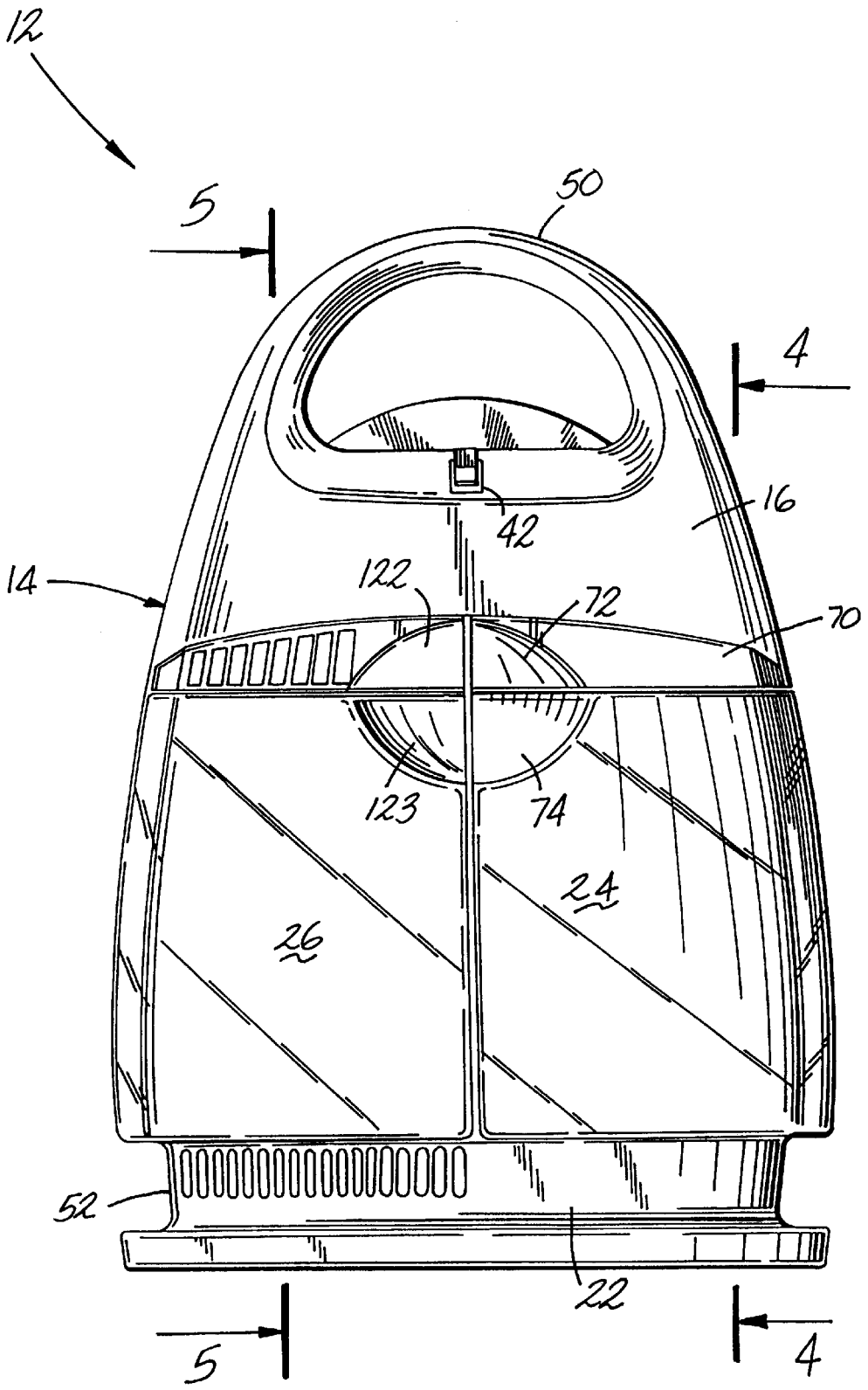
FIG. 2 is a front elevational view of the main housing water extraction cleaner housing of FIG. 1.

Referring now to FIGS. 1 and 2, a portable water extraction cleaner 12 according to the invention is shown. The cleaner 12 comprises a housing assembly 14 formed from a front shell 16, a rear shell 18 mounted to the front shell 16, a back plate 20 secured to the exposed wall of the rear shell 18, and a base 22 secured to the lower edge of the front shell 16. A clean solution tank 24 and a dirty solution tank 26 are selectively received in a recess 28 defined by the front shell 16 and the base 22. The clean solution tank 24 is fluidly connected to a solution pump 30 mounted inside the housing defined by the front and rear shell members 16, 18. Similarly, the dirty solution tank 26 is fluidly connected to an impeller fan housing 32 which is, in turn, fluidly connected to an accessory hose 34. An impeller fan (not shown) is provided inside the fan housing 32. Similarly, a motor (not shown) is mounted inside the motor housing 36 for driving the impeller fan. A transformer 38 is also positioned inside the housing assembly 14. The transformer 38 is interconnected to a conventional source of electrical current by a conventional electrical cord 40. The purpose of the transformer 38 is to step down the voltage that is supplied to the solution pump 39. A two-position electrical switch 42 is provided near the top of the front shell 16.

The front and rear shell members 16, 18 are assembled to one another to create a carrying handle 50 at the top of the housing 14. The shell members also cooperate with the base 22 to form a groove 52 around the base of the housing 14 for receiving the electrical cord 40 when the cord is stored. The back plate 20 cooperates with the rear shell 18 to provide suitable means for receiving the accessory hose 34 in the stored position. The hose 34 is wrapped around the body of the back plate 20 and a support 56 is provided on the rear surface of the back plate 20 for selectively receiving a tool handle 54 (FIG. 6) provided at the terminal end of the hose 34.

Figure 3:
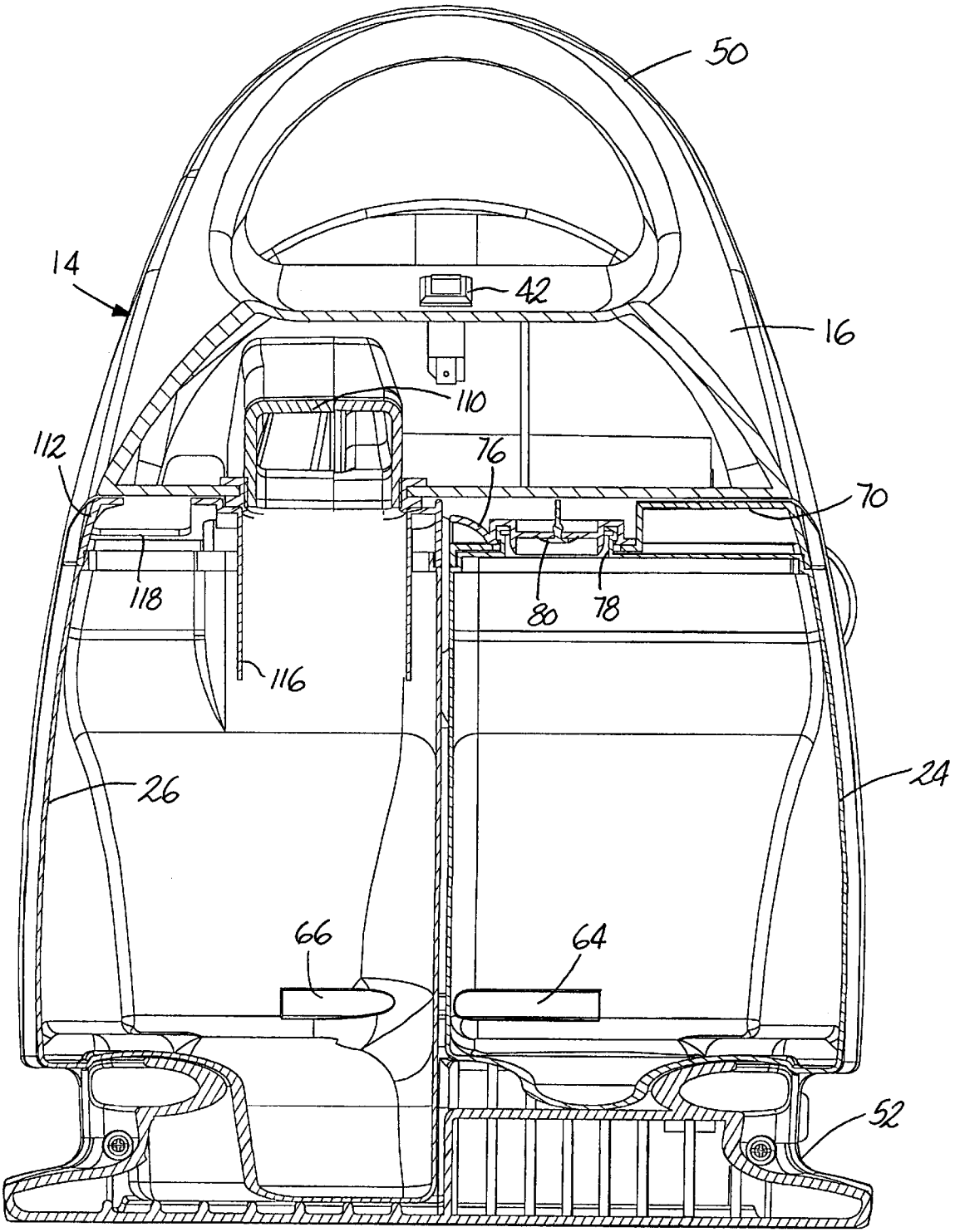
FIG. 3 is a partial, sectional view of the water extraction cleaner housing of FIG. 2.
Figure 4:
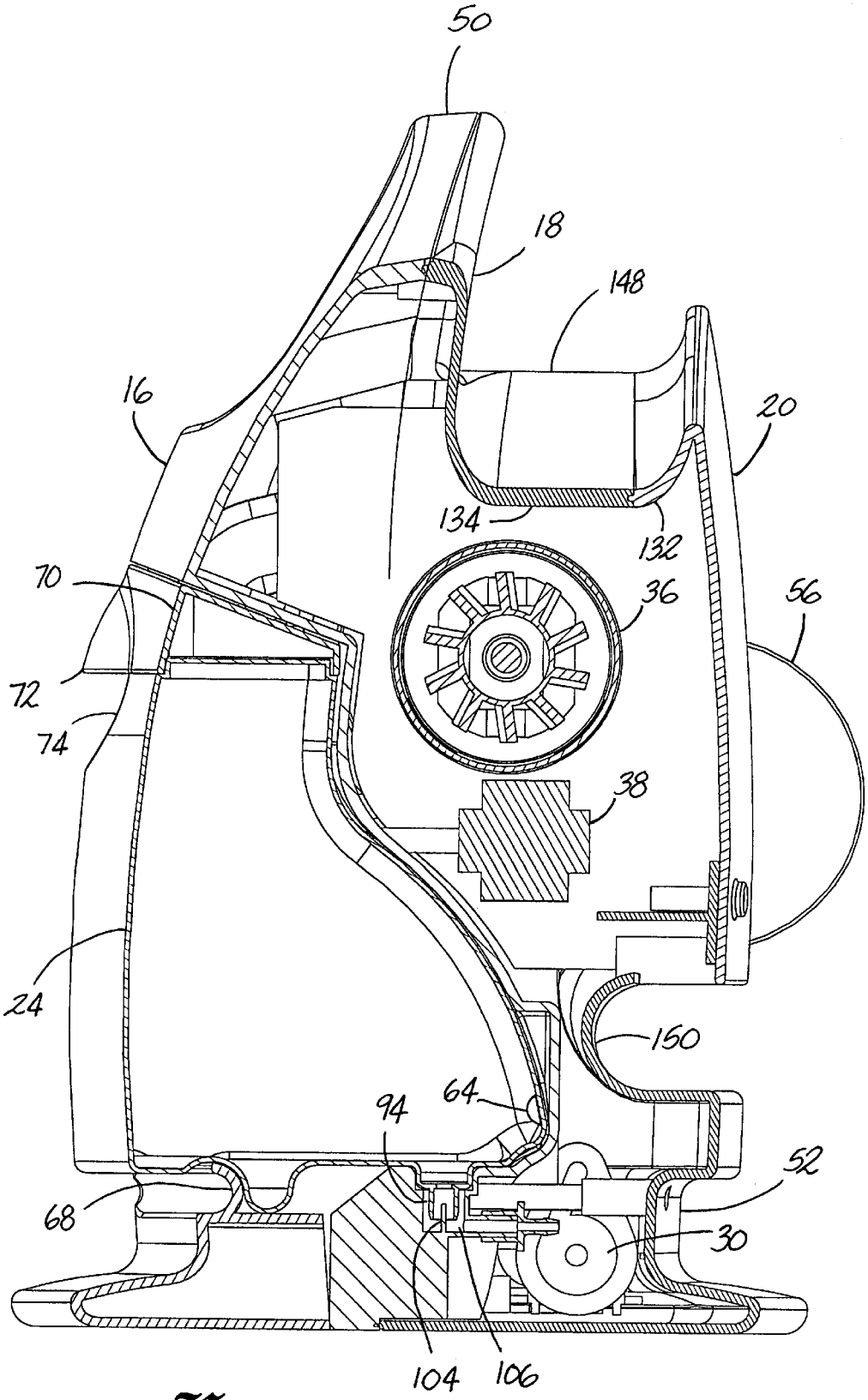
FIG. 4 is a partial, sectional view taken along lines 4—4 of the right side of the water extraction cleaner of FIG. 2.
Figure 5:
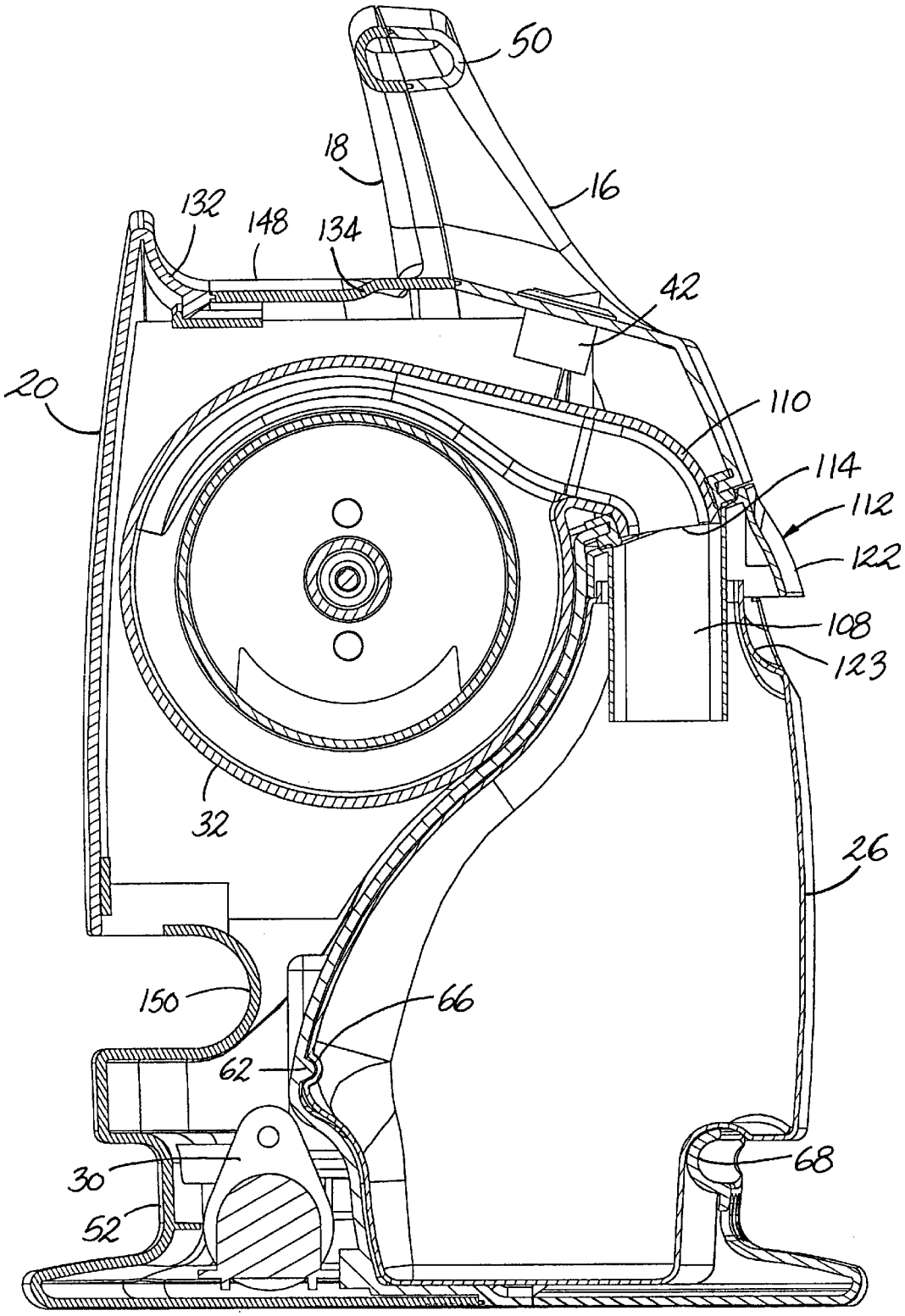
FIG. 5 is a partial, sectional view taken along lines 5—5 of the left side of the water extraction cleaner of FIG. 2.

The clean and dirty solution tanks 24, 26 are received in the recess 28 of the housing 14 and retained therein by a snap-fit connection between the tanks and the housing. As seen in FIGS. 3–5, the front surface of the front shell 16 includes a pair of detent projections 62 integrally formed thereon. Similarly, the rear surface of the clean and dirty tanks 24, 26 include integrally molded first and second detent recesses 64, 66, the first recess 64 being complementary to the first projection 60 and the second recess 66 being complementary to the second projection 62.

The method for mounting the clean and dirty tanks is identical, and therefore, the process will be described only with respect to the clean tank 24. The tank 24 is mounted in the housing 14 by first tipping the tank forward and inserting the base of the tank into the recess 28. In this position, the base of the tank 24 bears against a stop in the form of a pivot surface 68 integrally formed in the base 22. Next, the top of the tank is tilted rearwardly with respect to the housing 14, rotating about the pivot surface 68 until substantially the entire body of the tank 24 is received inside the recess 28. As the tank 24 approaches complete insertion, the detent recess 64 will snap-fit over the detent projection 60. The tank will be retained in the housing 14 between the opposed detent projection 60 and the stop or pivot surface 68. The process for removing the tank merely requires the user to tilt the top of the tank 24 forwardly and downwardly with respect to the housing 14, thereby dislodging the projection 60 from the recess 64 and then pivoting the tank 24 about the stop or pivot surface 68 a sufficient distance until the tank can be removed from the recess 28.

It will be readily apparent to the person of ordinary skill in the art that the structure thus far described might be modified to vary the manner in which the tanks are mounted in the housing and removed therefrom. For example, the tanks 24, 26 and the recess 28 might be so constructed that the tanks would be introduced to the recess by sliding them over a stop similar to the pivot surface 68 until they were fully inserted to drop into position behind the stop, to be held between the stop and any suitable detent means provided on the tanks and within the recess.

The clean water tank 24 includes a cap 70 having an integrally formed finger hold 72 provided therein. The finger hold 72 cooperates with a depression 74 in the tank 24 to provide an easy grip for the user in removing the tank 24 from the housing 28. The cap 70 also includes a pivoting closure 76 which selectively closes an aperture 78 for refilling the tank 24 with clean water. A one-way umbrella valve 80 is provided in the cap 70 and allows air to enter the tank as solution is withdrawn therefrom during operation of the cleaner to maintain the interior of the tank 24 at substantially ambient air pressure.

Figure 7:
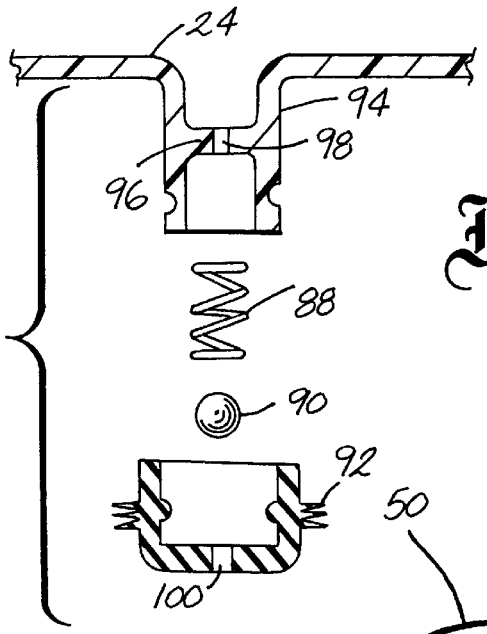
FIG. 7 is an exploded, partial sectional view of the valve means for the clean solution tank.

The clean tank 24 is fluidly connected to the solution pump 30 by conventional flow conduits (not shown) extending therebetween. In addition, a valve mechanism 86 (FIG. 7) is mounted in the bottom of the tank for controlling the flow of fluid therefrom. As seen in FIG. 7, the valve mechanism comprises a spring 88, a ball 90, and an elastomeric gasket 92 adapted to receive both the ball 90 and spring 88. A downwardly extending boss 94 is integrally formed on the bottom surface of the clean solution tank 24. The boss has a shoulder or restriction 96 integrally formed therein and a flow aperture 98 extending through the shoulder 96. In the assembled state, the spring 88 is captured between the shoulder 96 and the ball 90 which is in turn captured between the spring 88 and the gasket 92. The spring 88 biases the ball 90 against an aperture 100 formed in the end of the gasket 92, thereby preventing fluid from passing from the tank 24 through the shoulder flow aperture 98 and the gasket aperture 100.

As seen in FIG. 4, a pin or projection 104 extends upwardly from a fluid reservoir 106 formed in the machine housing 14. The fluid reservoir 106 is fluidly connected to the pump 30 through a conventional flow conduit (not shown). When the clean solution tank 24 is fully received in the housing 14, the projection 104 extends upwardly through the aperture 100 in the gasket 92 to displace the ball 90 from the aperture 100, thereby permitting the flow of fluid from the tank 24 into the fluid reservoir 106 and ultimately, to the solution pump 30. The discharge outlet of the pump 30 is fluidly connected to the cleaning tool through a conventional flow conduit 108 (FIG. 1).

The dirty solution tank 26 receives the air/water/dirty mixture from the outlet 110 of the impeller fan housing 32 and collects the dirty water while expelling the air. As seen in FIGS. 1–3 and 5, the dirty solution tank 26 includes a cap 112 having an integrally formed air/water separation means incorporated therein. The cap has an inlet aperture 114 adapted to receive the working air and fluid mixtures from the outlet 110 of the fan housing 32. The cap 112 comprises a flow conduit 108 extending downwardly from the aperture 114 into the open top of the tank 26. At least one baffle wall 116 extends downwardly from the cap 112 into the interior of the tank 26. The baffle 116 separates the incoming air/dirt/water mixture from the outlet aperture 118 of the cap 112 and the plurality of exhaust outlets 120 which are formed on the front surface of the cap 112. In operation the air/dirt/water mixture enters the tank 26 through the inlet aperture 114 of the cap. The working air mixture flows downwardly through the flow conduit 108 into the tank 26 and suddenly experiences a dramatic increase in the cross-sectional area, thereby causing the air to slow and the water and dirt to fall therefrom into the bottom of the tank 26. The separation of the air and water is further enhanced by the tortuous air path created by the baffle 116 extending downwardly into the tank 26. The air must pass around the baffle 116 and back upwardly into the cap 112 before discharge from the tank 26 through the exhaust outlets 120.

The dirty solution tank 26 is pivotally mounted into the housing 14 in the same manner as described above with respect to the clean solution tank 24. The cap 112 of the dirty solution tank similarly includes a finger hold 122 and the tank 26 includes a depression 123 so that the user can easily grasp the tank for removal and mounting to the housing 14.

Figure 6:
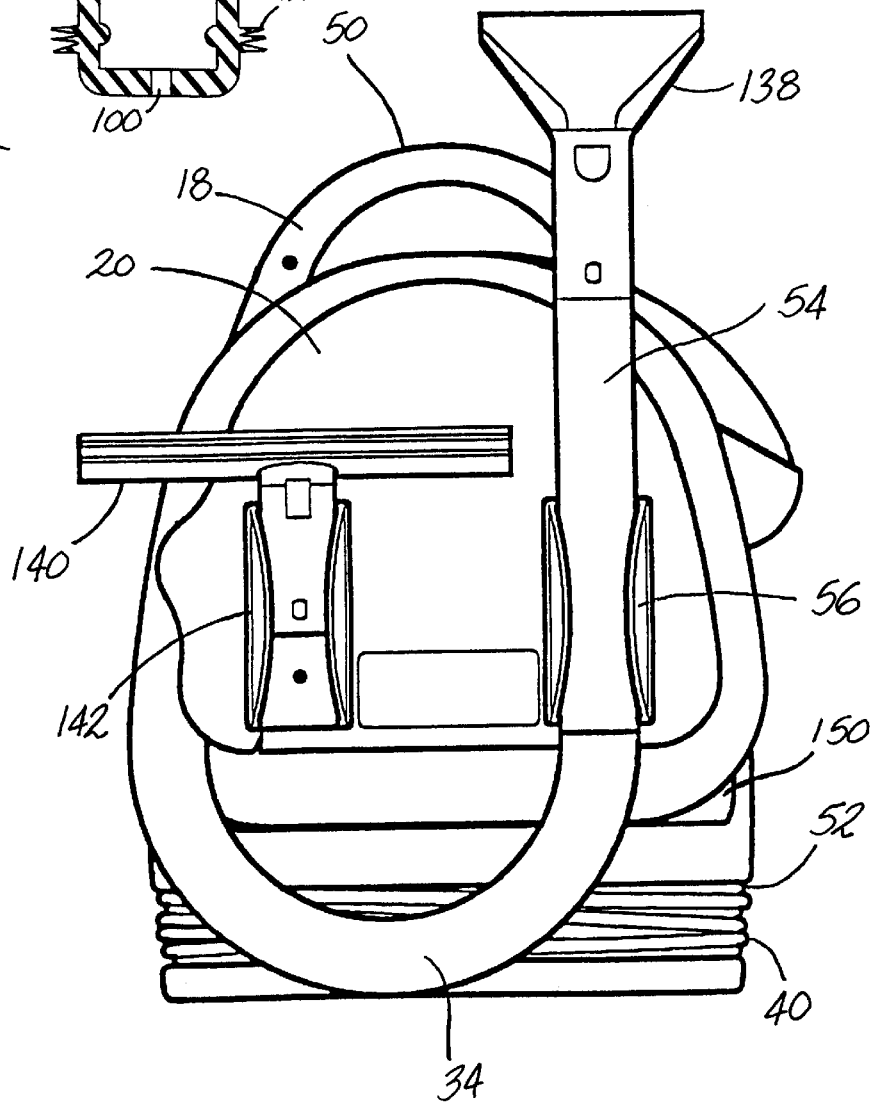
FIG. 6 is a rear elevational view of the water extraction cleaner of FIG.2.

The portable water extraction cleaner according to the invention is specifically designed so that the cleaner occupies a minimum amount of space when not in use. As described above, the electrical cord 40 is wrapped around the bottom of the housing and is received in a groove 52 provided therein. Similarly, the back plate 20 cooperates with the rear shell 18 to provide a suitable mounting for receiving the accessory hose 34 in the stored position. Specifically, the top portion of the back plate 20 further comprises a forwardly extending flange 132 which cooperates with a rearwardly extending flange 134 provided on the top portion of the rear shell 18 to define a double hose-width groove 148 for receiving the accessory hose 34 when the hose is not in use. A lower hose mounting grove 150 is formed by the bottom edge of the back panel 20 and the bottom, contoured portion of the rear shell 18. As seen in FIGS. 4–6, the hose 34 is preferably wrapped counter-clockwise around the housing 14 so that two portions of the hose 34 are received side-by-side in the upper groove 148 and at least one length of the hose 34 is received in the lower groove 150. The tool handle 54 is received in the tool support 56 to retain the hose 34 in this position. With this structure, the accessory hose 34 is contained close to the housing 14 thereby minimizing the storage space required for the cleaner when not in use. When so desired, the tool handle 54 is removed the snap-fitting support 56 and the hose is unwrapped from the grooves provided by the back plate 20 and rear shell 18.

Figure 9:
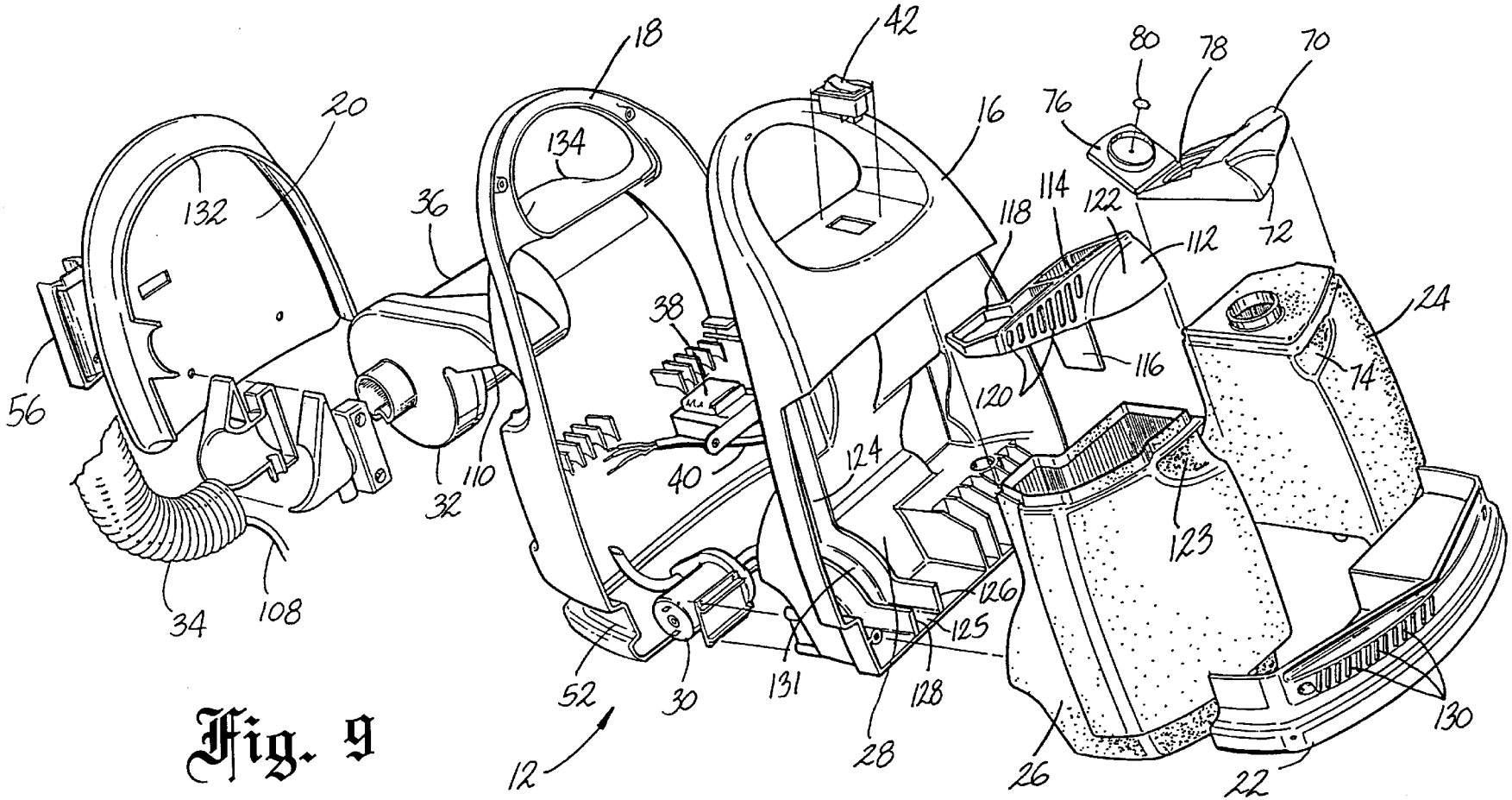
FIG. 9 is an exploded view of a second embodiment of the portable water extraction cleaner according to the invention.

FIG. 9 shows a modification to the air flow of the exhaust from the first embodiment. In the second embodiment, the exhaust outlets 120 on the cap 112 are removed, and instead, the exhaust air is directed to a channel 124 formed through the cooperation of the dirty water tank 26 and the front member 116. The channel is defined by a pair of forwardly extending side walls 126, 128, the exterior surface 125 of the front member 16, and the rear surface of the tank 26. The channel 124 extends along substantially the entire rear surface of the tank 26 and then along the bottom surface thereof. A plurality of exhaust outlets 130 are formed in the base 22. The air flows from the outlet aperture 118 of the cap 112, to the channel 124 and finally to the exhaust outlets 130 for ultimate discharge from the portable cleaner 12. Testing has shown that the second embodiment of the exhaust air flow path results in reduced noise and whistling from the exhaust air. This noise reduction could be further enhanced by providing a noise absorbent material 131, such as foam, along the interior surfaces of the channel 124.

Figure 8:
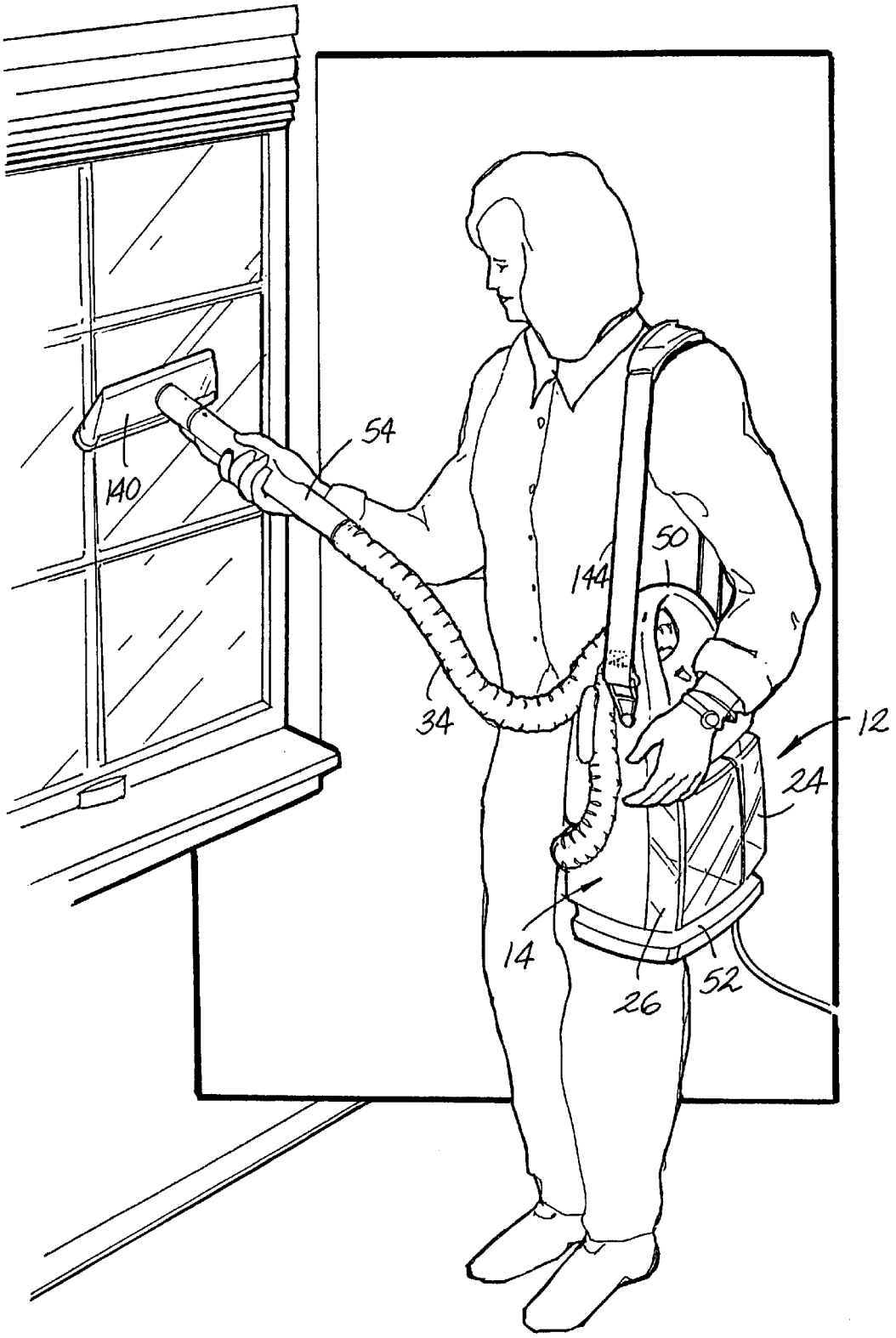
FIG. 8 is a perspective view of the portable water extraction cleaner in use with a window washing cleaning attachment.

The portable water extraction cleaner according to the invention is adapted for a wide variety of uses. As seen in FIGS. 6 and 8, the tool handle 54 is easily adapted to receive one of several different tools, depending upon the cleaning operation. FIG. 6 shows a conventional upholstery cleaning tool 138 mounted thereto. A window washing tool 140 can be provided in a second tool support 142 formed on the back plate 20. The upholstery cleaning tool 138 can be quickly and easily removed from the handle 54 and replaced with the window washing tool 140. Similarly, the upholstery tool 138 would be mounted to the second tool support 142.

FIG. 8 shows the portable water extraction cleaner 12 according to the invention in use with the window washing tool 140. Mobile use of the portable water extraction cleaner is accomplished through the use of a carrying strap 144, the ends of which are secured to the housing 14.

Additional details regarding the structure of the portable water extraction cleaner can be seen in the currently pending Design Pat. Application Nos. 29/051,756 and 29/051,562, now U.S. Des. Pat. No. D-381,481, which are expressly incorporated herein by reference.

Reasonable variation and modification are possible within the spirit of the foregoing specification and drawings without departing from the scope of the invention.

What is claimed is:

1. In a fluid extraction cleaning apparatus comprising a fluid delivery system for delivering clean solution to a surface to be cleaned, a fluid extraction system for extracting dirty solution and air from such a surface, and a housing supporting the delivery system and the extraction system, the improvement wherein the housing defines a recess for receiving a pair of tanks therein, the housing having a stop spaced from an inner surface of the recess, the stop being engageable by lower end portions of the tanks and formed and disposed to hold the tanks in engagement with the inner surface of the recess, whereby each of the tanks may be mounted on the housing by inserting the tank into the recess beyond the stop, the delivery system including an inlet on the housing disposed to receive clean solution from one of the tanks when said one tank is received in the recess, the extraction system including an outlet on the housing disposed to deliver dirty solution and air to the other of the tanks when said other tank is received in the recess.

2. A fluid extraction apparatus according to claim 1, wherein the stop forms a pivot surface, whereby each of the tanks may be mounted on the housing by tilting the tank to insert the lower end portion thereof into the recess and then rotating the tank to an upright position about the pivot surface.

3. A fluid extraction apparatus according to claim 1, wherein the inner surface comprises an upright surface of the recess complementary to upright surfaces of the tanks, the stop being adapted to hold the upright surfaces of the tanks in snug engagement with the upright surface of the recess.

4. A fluid extraction cleaning apparatus according to claim 1, wherein the inner surface comprises an upright surface of the recess complementary to upright surfaces of the tanks, the stop forming a pivot surface, whereby each of the tanks may be mounted on the housing by tilting the tank to insert the lower end portion thereof into the recess and then rotating the tank to an upright position about the pivot surface, the pivot surface being adapted to hold the upright surfaces of the tanks in snug engagement with the upright surface of the recess.

5. A fluid extraction cleaning apparatus according to claim 4, including a detent projection and a detent indentation interengageable therewith provided respectively on one of the upright recess surface and the rear surface of one of the tanks for releasably securing said one tank in the upright position when received in the recess.

6. A fluid extraction cleaning apparatus according to claim 4, wherein the upright recess surface is formed with a pair of detect projections and the rear surface of each of the tanks is formed with a detent indentation complementary to one of the detent projections and disposed to be interengaged therewith when said tank is received in the recess in the upright position.

7. A fluid extraction cleaning apparatus according to claim 1, wherein the housing includes a front shell, and a base member cooperating with the front shell to define the recess, the stop forming an upstanding element of the base member.

8. A fluid extraction cleaning apparatus comprising a fluid delivery system for delivering clean solution to a surface to be cleaned, a fluid extraction system for extracting dirty solution and air from such a surface, a housing supporting the delivery system and the extraction system, a first tank for supplying clean solution to the delivery system, and a second tank for receiving dirty solution from the extraction system, the housing defining a recess for removably receiving the tanks therein, an upright front surface of the recess being complementary to upright rear surfaces of the tanks, the housing having a pivot surface spaced forwardly from the upright recess surface, the pivot surface being engageable by lower end portions of the tanks and formed to hold the rear surfaces thereof in snug engagement with the front surface of the recess, whereby each of the tanks may be mounted on the housing by tilting the tank to insert the lower end portion thereof into the recess and then rotating the tank to an upright position about the pivot surface, the delivery system including an inlet provided on the housing in a position to receive clean solution from the first tank when received in the recess in the upright position, the extraction system including an outlet provided on the housing in a position to deliver dirty solution and air to the second tank when received in the recess in the upright position.

9. A fluid extraction cleaning apparatus according to claim 8, wherein the front recess surface is formed with a pair of detent projections and the rear surface of each of the tanks is formed with a detent indentation complementary to one of the detent projections and disposed to be interengaged therewith when said tank is received in the recess in the upright position.

10. A fluid extraction cleaning apparatus according to claim 8, wherein an upper portion of each of the tanks is formed with a finger hold to facilitate tilting said tank from the upright position about the pivot surface to remove said tank from the recess.

11. A fluid extraction cleaning apparatus according to claim 8, wherein the first tank is provided with a fluid outlet and a valve mechanism disposed in a normally closed condition to prevent flow of fluid from the tank outlet when the first tank is removed from the recess, the tank outlet being situated on the first tank in a position to be aligned with the delivery system inlet when the first tank is received in the recess in the upright position, a valve actuator being carried on the housing in a position to move the valve mechanism to an open condition permitting fluid flow from the tank outlet when aligned with the delivery system inlet.

12. A fluid extraction cleaning apparatus according to claim 11, wherein the first tank is provided with a boss extending outwardly therefrom, a shoulder formed within the boss, the tank outlet comprising a flow aperture extending through the shoulder to the interior of the first tank, the valve mechanism comprising a gasket received on the boss and having a passage therethrough aligned with the flow aperture, a ball within the gasket adapted to close the passage, and a spring extending between the ball and the shoulder to bias the ball toward the passage-closing position, the valve actuator comprising a pin formed on the housing in a position to extend into the passage and displace the ball from the passage-closing position when the first tank is received in the recess in the upright position.

13. A fluid extraction cleaning apparatus according to claim 12, wherein the valve actuator pin is disposed to enter the passage and engage the ball as the first tank is rotated about the pivot surface to the upright position within the recess.

* * * * *